US005664424A

United States Patent [19]

Olds

[11] Patent Number: 5,664,424

[45] Date of Patent: Sep. 9, 1997

[54] REFRIGERANT HANDLING SYSTEM AND METHOD WITH AIR PURGE AND MULTIPLE REFRIGERANT CAPABILITIES

[75] Inventor: Daniel L. Olds, Bryan, Ohio

[73] Assignee: SPX Corporation, Muskegon, Mich.

[21] Appl. No.: 686,712

[22] Filed: Jul. 26, 1996

[51] Int. Cl.[6] ..... F25B 43/04

[52] U.S. Cl. ..... 62/85; 62/475; 62/195

[58] Field of Search ..... 62/85, 474, 195

[56] References Cited

U.S. PATENT DOCUMENTS 5,313,805 5/1994 Blackmon et al. ..... 62/195

5,388,416 2/1995 Manz et al. ..... 62/195

*Primary Examiner*—John Sollecito

*Attorney, Agent, or Firm*—Barnes, Kisselle, Raisch, Choate, Whittemore & Hulbert

[57] ABSTRACT

A refrigerant handling system that includes a closed chamber having an inlet for directing refrigerant in liquid phase into the chamber such that the refrigerant collects at a lower portion of the chamber and non-condensibles are trapped in the upper portion of the chamber over the refrigerant. The rate of increase in level of refrigerant in the chamber is measured as liquid phase refrigerant is directed thereto, and non-condensibles are purged from the upper portion of the chamber when the rate of increase of refrigerant level is less than a preselected threshold.

15 Claims, 1 Drawing Sheet

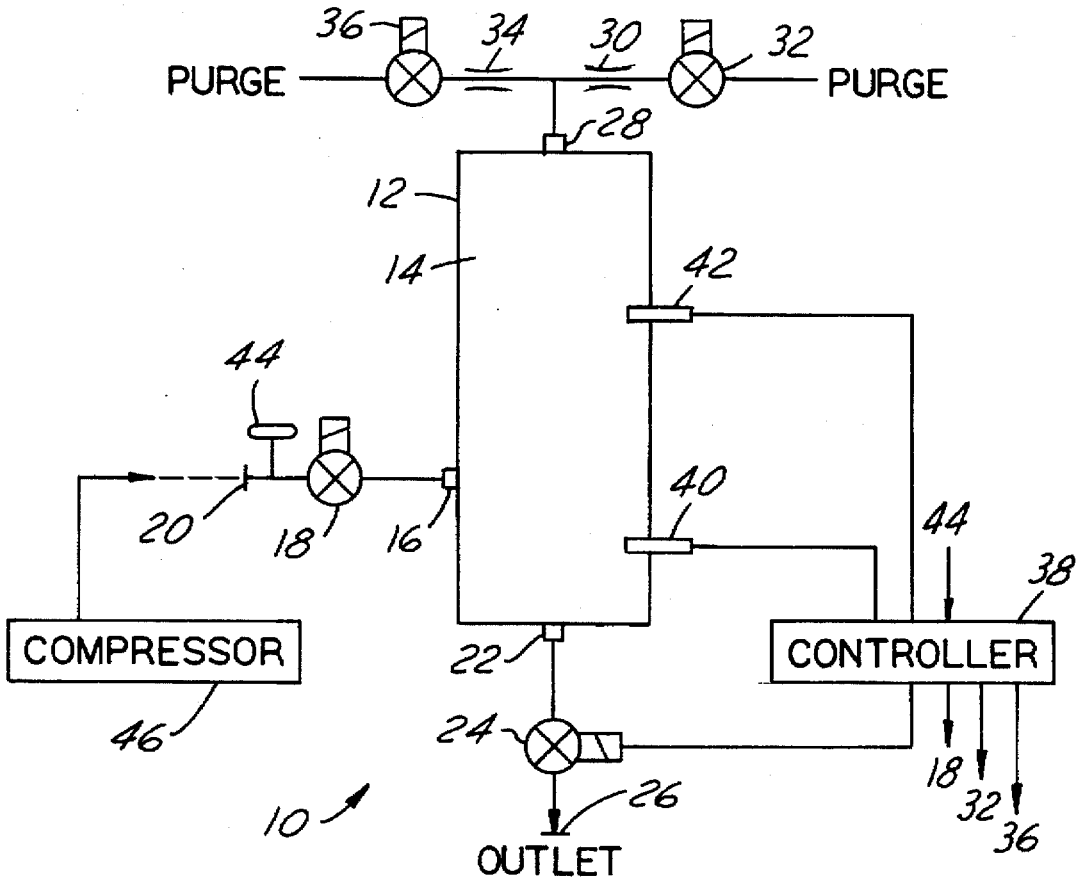
PURGE
PURGE
36
34
30
32
28
12
14
42
44
40
20
18
16
44
38
COMPRESSOR
CONTROLLER
22
46
24
18
32
36
26
10
OUTLET

REFRIGERANT HANDLING SYSTEM AND METHOD WITH AIR PURGE AND MULTIPLE REFRIGERANT CAPABILITIES

The present invention is directed to refrigerant handling systems and methods, and more particularly to purging air and other non-condensibles from refrigerants.

BACKGROUND AND SUMMARY OF THE INVENTION

In the art of refrigerant handling, them is often a need for purging air and other non-condensibles from refrigerant in the refrigerant handling system. U.S. Pat. No. 5,005,369 discloses a system for recovering refrigerant from refrigeration equipment under service with automatic or manual air purge capabilities. This system has enjoyed great commercial acceptance and success for both R-12 and R-134a refrigerant recovery/recycling units in the automotive air conditioner service market. However, the trend in the market, particularly the automotive service market, is toward single service systems that can handle multiple refrigerants. U.S. Pat. Nos. 5,063,749 and 5,181,391 disclose manual purge systems for multiple-refrigerant handling systems, and U.S. Pat. No. 5,285,647 discloses an automatic purge control for a multiple-refrigerant handling system. See also Manz, "How to Handle Multiple Refrigerants In Recovery and Recycling Equipment," *ASHRAE Journal*, April 1991, pages 22–30, and Manz, *The Challenge of Recycling Refrigerants*, Business News Publishing, 1995, Chapter 6.

U.S. application Ser. No. 08/463,709, filed Jun. 5, 1995, discloses a refrigerant handling system that includes a chamber for holding refrigerant, and a refrigerant pump for directing refrigerant into the chamber so that the refrigerant collects in liquid phase at the lower portion of the chamber while air and other non-condensibles collect in vapor phase at the upper portion of the chamber over the refrigerant. Sensors are responsive to temperature of the refrigerant entering the chamber and temperature of the refrigerant collected in the lower portion of the chamber. Partial pressure of non-condensibles in the upper portion of the chamber is determined as a function of a difference between such temperatures, and the non-condensibles are purged from the upper portion of the chamber when such partial pressure reaches a selected threshold.

Although the purge control techniques disclosed in the noted patents, publications and application have enjoyed commercial success, and addressed problems theretofore extant in the art, further improvements remain desirable. In particular, there is a need in the art for an automatic purge control technique for use in refrigerant handling systems, particularly refrigerant recovery systems, that is inexpensive, that is intended and adapted for use in conjunction with multiple differing types of refrigerants having differing pressure/temperature characteristics, and that can be readily incorporated into refrigerant handling systems at the time of manufacture or retrofitted to systems in the field. It is a general object of the present invention to provide a refrigerant handling system and method that address these needs in the art.

A refrigerant handling system in accordance with the present invention includes a closed chamber having an inlet for directing refrigerant in liquid phase into the chamber such that the refrigerant collects at a lower portion of the chamber and non-condensibles are trapped in the upper portion of the chamber over the refrigerant. The rate of increase in level of refrigerant in the chamber is measured as liquid-phase refrigerant is directed thereto, and non-condensibles are purged from the upper portion of the chamber when the rate of increase of refrigerant level is less than a preselected threshold. Briefly stated, the present invention operates on the principle that air and other non-condensibles that must be purged from the refrigerant are relatively incompressible as compared with refrigerant vapor. Thus, when refrigerant in liquid phase is fed into the closed chamber, the rate of increase of refrigerant level within the chamber is determined in part by the back-pressure of non-condensibles trapped within the upper portion of the chamber. When such back-pressure of non-condensibles is such that the rate of flow of refrigerant into the chamber, and the corresponding rate of refrigerant level increase within the chamber, is less than a predetermined threshold, the non-condensibles may be purged or vented from the upper portion of the chamber.

In the preferred embodiment of the invention, first and second liquid refrigerant level sensors are coupled to the chamber and responsive to level of refrigerant for providing associated electronic level signals. These level signals are directed to a controller, which functions to measure the time required for the refrigerant level to vary between the levels associated with the respective sensors. When such time is greater than an associated threshold time, the upper portion of the chamber is vented to atmosphere through a flow control orifice. Most preferably, first and second venting orifices are provided, and the controller is operative to vent the upper portion of the chamber through the first orifice when the time required for the change in liquid refrigerant level is greater than a first threshold, and to vent the upper portion of the chamber through the second orifice larger than the first orifice when such time is greater than a second threshold greater than the first threshold. A pressure sensor at the chamber inlet in the preferred embodiment of the invention prevents overloading of any pump or compressor that feeds the chamber by opening the inlet and outlet valves as required to provide a low-pressure refrigerant flow path through the chamber.

BRIEF DESCRIPTION OF THE DRAWING

The invention, together with additional objects, features and advantages thereof, will be best understood from the following description, the appended claims and the accompanying drawing, which is a schematic diagram of a refrigerant handling system in accordance with a presently preferred embodiment of the invention.

DETAILED DESCRIPTION OF PREFERRED EMBODIMENT

The drawing illustrates a refrigerant handling system 10 in accordance with a presently preferred embodiment of the invention as comprising a vessel 12 that forms a closed internal chamber 14. Chamber 14 has an inlet port 16 for receiving refrigerant in liquid phase through an inlet solenoid valve 18 and an inlet fitting 20. Chamber 14 has an outlet port 22 at the lower portion thereof for feeding liquid phase refrigerant through an outlet solenoid valve 24 and an outlet fitting 26 to a desired refrigerant destination, such as a liquid refrigerant storage container in a refrigerant recovery system application or a holding vessel or expansion valve in a closed refrigeration system. A purge port 28 opens into the upper portion of chamber 14 for venting air and other non-condensibles either through an orifice 30 and an associated solenoid valve 32, or through an orifice 34 and an associated solenoid valve 36. An electronic controller 38 receives input signals from a first liquid refrigerant level sensor 40 disposed in the lower portion of vessel 12, a second liquid refrigerant level sensor 42 disposed in the upper portion of vessel 12, and a pressure sensor 44 coupled between inlet 20 and valve 18. Controller 38 provides electrical output signals to control operation of outlet solenoid valve 24, inlet solenoid valve 18 and purge control solenoid valves 32, 36.

In operation, inlet fitting 20 is first connected to a source of refrigerant in liquid phase, such as a refrigerant recovery system or refrigerant handling system of the type disclosed in the several U.S. patents referenced above, or to any refrigerant handling system that can provide a flow of refrigerant in liquid phase from a refrigerant compressor or other type of refrigerant pump 46. Similarly, outlet fitting 26 is connected to a refrigerant storage container or other suitable means for utilizing or storing refrigerant in liquid phase from which air and other non-condensibles have been purged. Inlet solenoid valve 18 is then opened by controller 38, while valves 24, 32 and 36 are closed. As refrigerant flows into chamber 14, the refrigerant level first increases to the level of sensor 40, and then continues to increase toward the level of sensor 42. When the liquid refrigerant level reaches sensor 40, operation of three timers within controller 38 is initiated. If the liquid refrigerant level within chamber 14 increases to the level of sensor 42 before a first of these timers times out, then inlet valve 18 is closed, outlet valve 24 is opened and the liquid refrigerant is fed to the desired destination. However, if the level of refrigerant within chamber 14 does not reach the level of sensor 42 within the allotted time of the first timer, due to back-pressure of air and other non-condensibles at the upper portion of chamber 14, controller 38 opens purge valve 36 to vent the upper portion of the chamber to atmosphere through orifice 34. If the refrigerant within chamber 14 still has not reached the level of sensor 42 when a second longer timer within controller 38 times out, then controller 38 opens valve 32 to vent the upper portion of the chamber to atmosphere through orifice 30, which is larger than orifice 34. If the level of liquid refrigerant still has not reached sensor 42 when the third and longest timer times out, solenoid valve 32 is closed, inlet valve 18 remains open, and an alarm condition is indicated.

If at any time during the operation described above pressure sensor 44 detects excess pressure at inlet 20, either with valve 18 open and valve 24 closed while chamber 14 fills, or with valve 18 closed and valve 24 open while chamber 24 drains, controller functions to open both valves 18, 24 (and close valves 32, 36 if open) so that a low-pressure path is pivoted for the output of compressor 46. This feature prevents overload of compressor 46, which would otherwise require an extended delay while the compressor cools down.

There has thus been disclosed a refrigerant handling system and method that fully satisfies the objects and aims previously set forth. In particular, the system can be readily incorporated in refrigerant handling equipment at the time of manufacture, and can be provided as a package for retrofit of existing refrigerant handling equipment in which air purge capabilities are desired. The disclosed system and method are inexpensive to manufacture and operate. Since the system and method of the present invention are responsive solely to rate of increase of refrigerant level within a closed vessel, and to pressure of non-condensibles within the vessel, and not to characteristics of the refrigerant itself, the system and method of the present invention may be readily implemented in connection with any type of refrigerant, and in systems for handling differing types of refrigerant without requiring recalibration. That is, operation of the disclosed embodiment of the invention is substantially independent of refrigerant type.

I claim:

1. A method of purging non-condensibles from refrigerant that comprises the steps of:

(a) directing refrigerant in liquid phase into a closed chamber such that the refrigerant collects at a lower portion of said chamber and non-condensibles are trapped in an upper position of said chamber over the refrigerant, (b) determining rate of increase in level of refrigerant in said chamber in said step (a), and (c) purging non-condensibles from the upper portion of said chamber when said rate of increase is less than a preselected threshold.

2. The method set forth in claim 1 wherein said step (c) comprises the step of venting said upper portion of said chamber to atmosphere at a rate that varies as a function of said rate of level increase determined in said step (b).

3. The method set forth in claim 2 wherein said step (c) comprises the steps of:

(c1) venting said upper portion of said chamber to atmosphere at a first rate when said rate of increase is less than a first preselected threshold, and (c2) venting said upper portion of said chamber to atmosphere at a second rate greater than said first rate when said rate of increase is less than a second preselected threshold less than said first preselected threshold.

4. The method set forth in claim 3 wherein said step (c1) comprises the step of venting said upper portion of said chamber to atmosphere through first orifice means, and wherein said step (c2) comprises the step of sending said upper portion of said chamber to atmosphere through second orifice means having a cross sectional area to non-condensible flow that is greater than that of said first orifice means.

5. The method set forth in claim 1 wherein said step (b) comprises the steps of:

(b1) providing level sensing means in said chamber, and (b2) determining rate of increase of refrigerant level in said chamber with respect to said level sensing means.

6. The method set forth in claim 5 wherein said step (b1) comprises the step of providing a pair of liquid refrigerant level sensors at differing level positions with said chamber, and wherein said step (b2) comprises the step of determining rate of increase of refrigerant level as a function of time required for refrigerant level to vary between said sensors at said differing level positions.

7. The method set forth in claim 6 wherein said step (c) comprises the step of:

(c1) venting said upper portion of said chamber to atmosphere at a first rate when time required for refrigerant level to increase between said sensors is greater than a first preselected threshold.

8. The method set forth in claim 7 wherein said step (c) comprises the additional step of:

(c2) venting said upper portion of said chamber to atmosphere at a second rate greater than said first rate when time required for refrigerant level to increase between said sensors is greater than a second preselected threshold greater than said first threshold.

9. A refrigerant handling system that includes:

a closed chamber for holding refrigerant, means for directing refrigerant in liquid phase into said chamber such that the refrigerant collects at a lower portion of said chamber and non-condensibles are trapped in an upper portion of said chamber over the refrigerant, means for measuring rate of increase in level of refrigerant in said chamber, and means for purging non-condensibles from said upper portion of said chamber when said rate of increase is less than a selected threshold.

10. The system set forth in claim 9 wherein said means for measuring rate of increase in refrigerant level comprises refrigerant level sensing means operatively coupled to said chamber.

11. The system set forth in claim 10 wherein said refrigerant level sensing means comprises a pair of liquid refrigerant level sensors operatively coupled to said chamber so as to be responsive to differing levels of refrigerant within said chamber.

12. The system set forth in claim 11 wherein said means for measuring rate of increase of refrigerant level comprises means for determining said rate of increase as a function of time required for refrigerant level to increase from a level associated with one of said sensors to a level associated with the other of said sensors.

13. The system set forth in claim 9 wherein said means for purging non-condensibles comprises orifice means and means for opening said upper portion of said chamber to atmosphere through said orifice means.

14. The system set forth in claim 13 wherein said means for purging non-condensibles comprises first orifice means and second orifice means larger than said first orifice means, and means for selectively purging non-condensibles through said first and said second orifice means as a function of rate of increase of refrigerant level in said chamber.

15. The system set forth in claim 9 wherein said refrigerant-directing means comprises an inlet valve for admitting infringement into said chamber, an outlet valve for draining refrigerant from said chamber, and means for opening both of said inlet and outlet valves so as to provide a low-pressure refrigerant flow path through said chamber in the event of excessive pressure at said inlet valve.

* * * * *